US007861463B1

(12) United States Patent
Nottage

(10) Patent No.: US 7,861,463 B1
(45) Date of Patent: Jan. 4, 2011

(54) SLIDING DOOR GRAB BAR OPENER

(76) Inventor: James T. Nottage, 86812 McMorott La., Eugene, OR (US) 97402

( * ) Notice: Subject to any disclaimer, the term of this patent is extended or adjusted under 35 U.S.C. 154(b) by 482 days.

(21) Appl. No.: 11/999,790

(22) Filed: Dec. 7, 2007

Related U.S. Application Data

(60) Provisional application No. 60/951,642, filed on Jul. 24, 2007.

(51) Int. Cl.
*E05B 1/00* (2006.01)
*E05D 15/06* (2006.01)

(52) U.S. Cl. ..... 49/460; 49/404; 16/436; 16/429; 52/204.51

(58) Field of Classification Search ..... 49/460, 49/461, 404; 16/436, 439, 429; 52/204.51; 248/200.1, 343
See application file for complete search history.

(56) References Cited

U.S. PATENT DOCUMENTS 1,946,050 A * 2/1934 Werner ..... 49/461
3,819,216 A * 6/1974 Richardson ..... 292/259 R
3,825,290 A 7/1974 Messina et al.
3,860,350 A * 1/1975 Rogers ..... 403/104
4,078,836 A * 3/1978 Wilson ..... 292/259 R
4,178,718 A * 12/1979 Laby ..... 49/411
4,198,998 A * 4/1980 Duffy ..... 135/88.1
4,314,721 A 2/1982 Clark
4,437,694 A 3/1984 Lillo
4,572,557 A * 2/1986 Taylor ..... 292/263
4,659,051 A * 4/1987 Propp et al. ..... 248/546
4,667,992 A * 5/1987 Roden, Jr. ..... 292/259 R
4,779,910 A * 10/1988 Dameron ..... 292/259 R
4,862,554 A * 9/1989 Chojnacki ..... 16/412
5,253,905 A * 10/1993 Hutson ..... 292/92
5,282,656 A * 2/1994 Fizer ..... 292/259 R
5,303,894 A * 4/1994 Deschamps et al. ..... 248/343
5,339,567 A * 8/1994 Pierpont et al. ..... 49/55
5,340,172 A * 8/1994 Sweet ..... 292/259 R
5,447,046 A * 9/1995 Duffus ..... 70/101
5,497,579 A * 3/1996 Walters ..... 49/460
5,810,302 A * 9/1998 McCance ..... 248/200.1
5,826,923 A * 10/1998 Bethurem ..... 292/259 R
5,899,509 A * 5/1999 Ferguson et al. ..... 292/259 R
7,628,430 B2 * 12/2009 Whitaker ..... 292/259 R

* cited by examiner

*Primary Examiner*—Jerry Redman
(74) *Attorney, Agent, or Firm*—Robert E. Howard

(57) ABSTRACT

A sliding door grab bar opener for opening and closing a sliding door. The opener includes outside and inside tube members, each having first and second ends. The inside tube member is positioned within the outside tube member and is adapted to slide from a fully retracted configuration with the first end of the inside tube member being located adjacent the first end of the outside tube member to a fully extended configuration with the first end of the inside tube member being located adjacent the second end of the outside tube member. First and second end stanchion members are attached to the outside and inside tube members adjacent their first and second ends, respectively. A middle stanchion member is attached to the outside tube member adjacent its second end. The stanchion members are adapted to be attached to the frames of the sliding door panels by fastener means.

5 Claims, 3 Drawing Sheets

SLIDING DOOR GRAB BAR OPENER

CROSS-REFERENCE TO RELATED APPLICATIONS

This application claims the benefit of U.S. Provisional Application No. 60/951,642, filed Jul. 24, 2007, the entire contents of which are hereby incorporated by reference.

BACKGROUND OF THE INVENTION

The present invention relates to a sliding door grab bar opener.

Persons entering or leaving a room through a sliding glass door can sometimes mistakenly think that the door is open when it is in fact closed, and bump into it which can cause injury. This can be particularly troubling to older people who are in a wheel chair or other wheeled transport device.

Existing door handles on sliding glass doors can sometimes be difficult to operate, particularly for older people.

SUMMARY OF THE INVENTION

It is an object of the present invention to provide a grab bar opener for sliding doors that provides a visual cue as to the door configuration, and provides a means to allow the door to be more easily opened and closed with the use of both hands.

The sliding door grab bar opener of the present invention includes outside and inside tube members, each having first and second ends.

The inside tube member is positioned within the outside tube member, and is adapted to slide from a fully retracted configuration with the first end of the inside tube member being located adjacent the first end of the outside tube member to a fully extended configuration with the first end of the inside tube member being located adjacent the second end of the outside tube member.

A first end stanchion member is attached to the outside tube member adjacent its first end, and a second end stanchion member is attached to the inside tube member adjacent its second end. A middle stanchion member is attached to the outside tube member adjacent its second end. The stanchion members are adapted to be attached to the frames of the fixed and sliding panel portions of a sliding door by fastener means.

DESCRIPTION OF PREFERRED EMBODIMENTS

Figure 1:
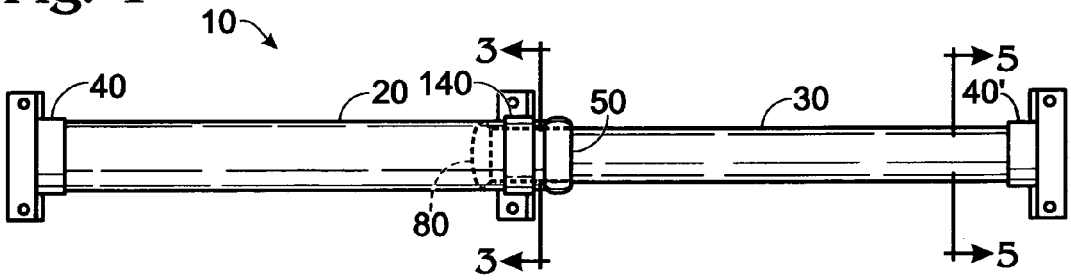
FIG. 1 is a side elevation view of the sliding door grab bar opener of the present invention, shown in its fully extended configuration.
Figure 2:
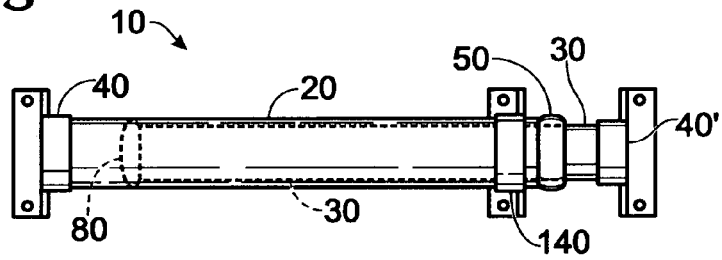
FIG. 2 is a side elevation view of the sliding door grab bar opener shown in its fully retracted configuration.
Figure 7:
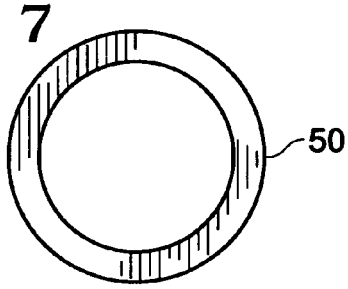
FIG. 7 is a front elevation view of the dust guard.
Figure 4:
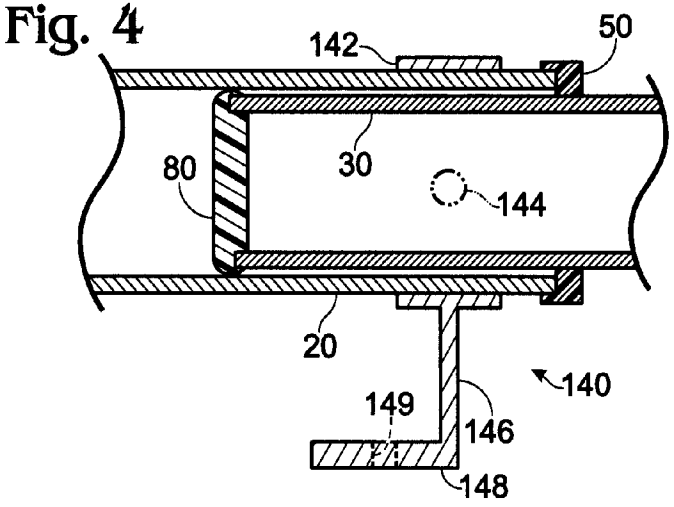
FIG. 4 is a sectional view of the middle stanchion taken along line 4-4 of FIG. 3.
Figure 3:
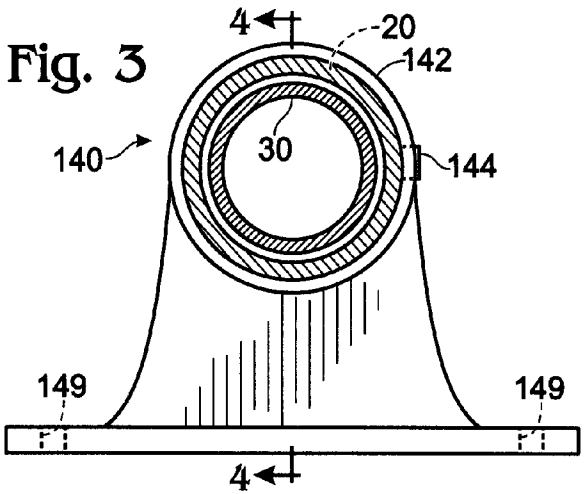
FIG. 3 is a front elevation view of the middle stanchion used to support and attach the grab bar opener.

Grab bar opener 10 includes an outside tube member 20 and an inside tube member 30. The outer diameter of inside tube member 30 is slightly smaller than the inner diameter of outside tube member 20. Inside tube member 30 is adapted to be received within outside tube member 20 and to slide between a fully extended configuration shown in FIG. 1 to a fully retracted configuration shown in FIG. 2. Outside tube member 20 and inside tube member 30 have a common longitudinal axis.

The first, outer end of outside tube member 20 is attached to a first end stanchion member 40, and the second, inner end of outside tube member 20 is attached to a dust cover 50.

Figure 6:
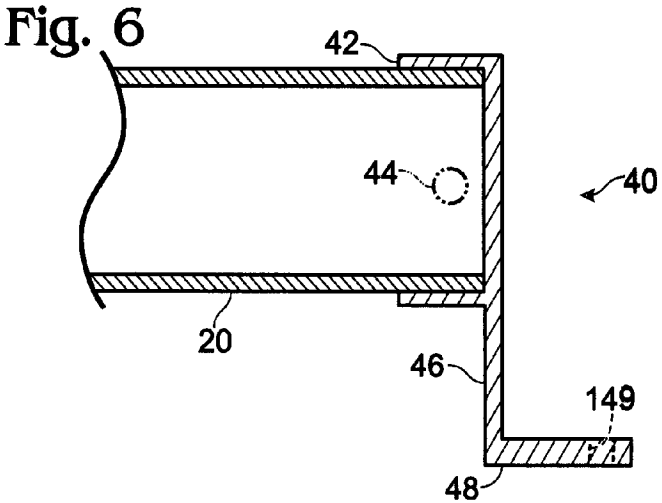
FIG. 6 is a sectional view of an end stanchion taken along line 6-6 of FIG. 5.
Figure 5:
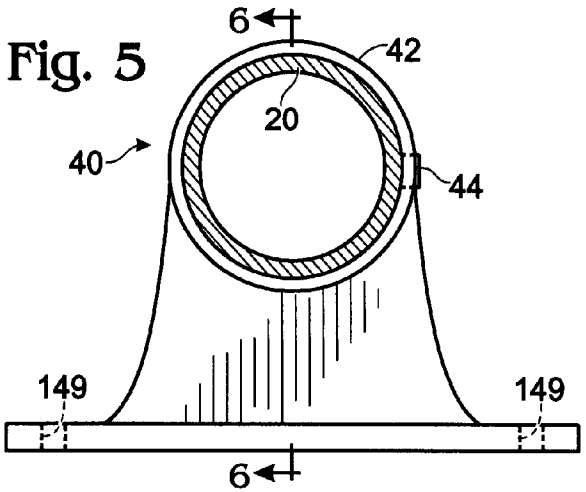
FIG. 5 is a front elevation view of an end stanchion used to support and attach the grab bar opener.

As best seen in FIGS. 5 and 6, first end stanchion member 40 includes a collar portion 42 which fits over outside tube member 20 and is attached thereto by any suitable means, such as set screw 44. An L-shaped attachment bracket extends from collar portion 42 and has a first leg 46 and a second leg 48. First leg 46 has a major plane perpendicular to the longitudinal axis of outside tube member 20, and is adapted to cap the opening in outside tube member 20. Second leg 48 has a major plane substantially parallel to the longitudinal axis of outside tube member 20. Openings 49 in second leg 48 are adapted to receive fasteners for attaching stanchion 40 to a sliding door frame.

Dust cover 50 is washer-shaped, and its inside diameter is substantially the same as the outside diameter of inside tube member 30. Dust cover 50 prevents dust from entering the space between outside tube member 20 and inside tube member 30, and also acts to support inside tube member 30.

The first, inner end of inside tube member 30 is attached to a circular end piece 80 whose outer circumference is in sliding engagement with the inner wall of outside tube member 20. End piece 80 acts as a support member for the inner end of inside tube member 30 and as a stop member in abutment with dust cover 50 when inside tube member 30 is extended to its maximum desired length. Although preferably attached to the first end of inside tube member 30, it could be located slightly forward of the first end.

The second, outer end of inside tube member 30 is attached to a second end stanchion member 40' which is identical to first end stanchion member 40.

A middle stanchion member 140 includes a collar portion 142 which fits over outside tube member 20. Middle stanchion member 140 can slide along outside tube member 20 to a location in alignment with that portion of the sliding door frame to which it is to be attached, and then attached to outside tube member 20 by any suitable means, such as set screw 144. An L-shaped attachment bracket extends from a mid-portion of collar portion 142. L-shaped attachment bracket has a first leg 146 having a major plane perpendicular to the longitudinal axis of outside tube member 20 and a second leg 148 having a major plane substantially parallel to the longitudinal axis of outside tube member 20. An opening 149 in second leg 148 is adapted to receive a fastener for attachment to a sliding door frame.

In use, the grab bar opener 10 is attached to a sliding door with the common longitudinal axis of tubes 20 and 30 substantially parallel to the floor, and at a height above the floor to meet the requirements of the user. The sliding door includes a sliding panel portion 70 and a fixed panel portion 90. First end stanchion 40 is attached to the outer vertical frame member of sliding panel portion 70, and second end stanchion 40 is attached to the outer vertical frame member of fixed panel portion 90. Middle stanchion member 140 is attached to the inner vertical frame member of sliding panel portion 70.

Figure 8:
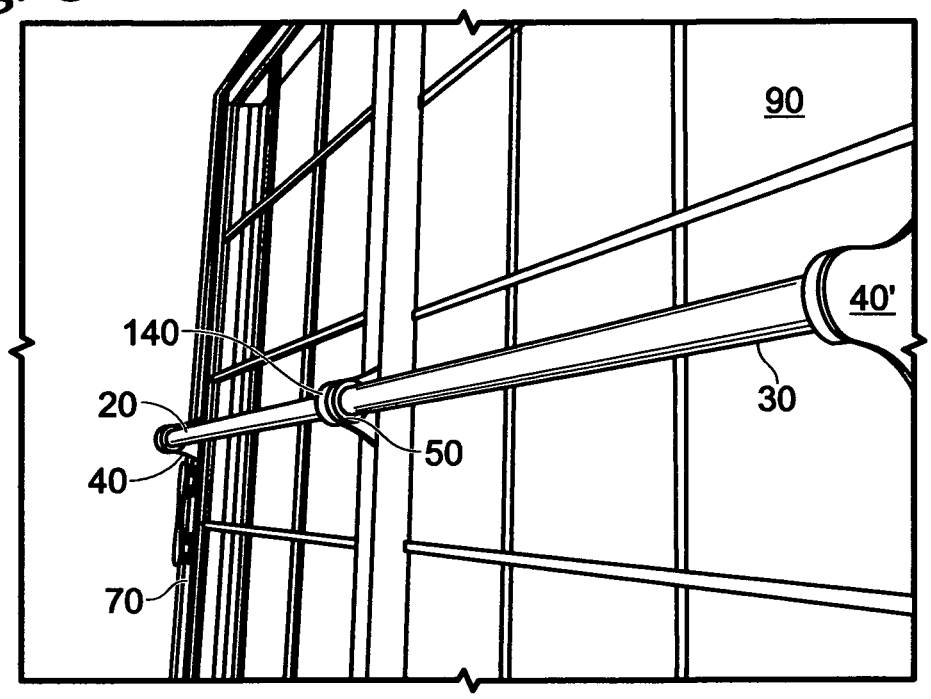
FIG. 8 is a partial perspective view of the grab bar opener shown attached to a sliding door, the grab bar opener being shown in its fully extended position with the door closed.
Figure 9:
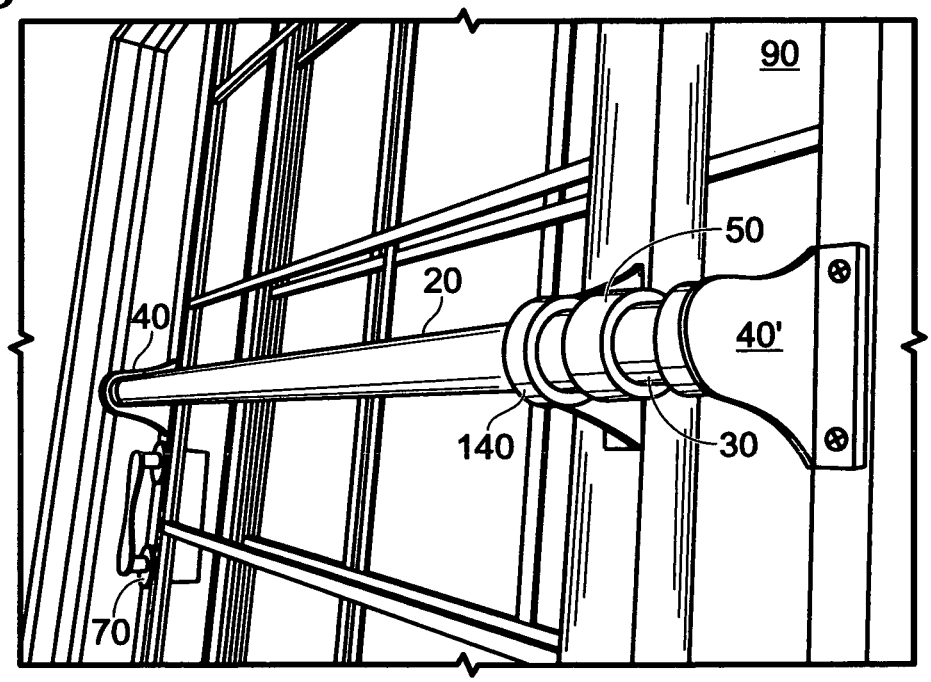
FIG. 9 is a partial perspective view of the grab bar opener shown attached to a sliding door, the grab bar opener being shown in its retracted position with the door open.

With the sliding panel portion 70 of the sliding door closed, as seen in FIG. 8, inside tube member 30 is substantially fully extended outside of outside tube member 20. When it is desired to open the sliding panel portion 70 of the sliding door, outside tube member 20 is grasped and pushed towards inside tube member 30, thereby causing inside tube member 30 to slide into outside tube member 20 until inside tube member 30 is fully or partially retracted within outside tube member 20, as seen in FIG. 9. When it is desired to close the sliding panel portion 70 of the sliding door, outside tube member 20 is grasped and pushed away from inside tube member 30, thereby causing inside tube member 30 to slide out of outside tube member 20 until the door is closed.

The dimensions and other properties of grab bar opener 10 are selected to comply with the grab bar requirements of the Americans with Disabilities Act.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A sliding door having a fixed panel and a sliding panel, said panels each having inner and outer vertical frame members, and a grab bar opener for moving said sliding panel, said grab bar opener comprising:

an outside tube member having first and second ends and an inner wall;

an inside tube member having first and second ends, said inside tube member being positioned within said outside tube member, said inside tube member being adapted to slide from a fully retracted configuration with said first end of said inside tube member being located adjacent said first end of said outside tube member to a fully extended configuration with said first end of said inside tube member being located adjacent said second end of said outside tube member;

a first end stanchion member being attached to said outside tube member adjacent its first end;

a second end stanchion member being attached to said inside tube member adjacent its second end; and a middle stanchion member being attached to said outside tube member adjacent its second end;

said first end stanchion member and said middle stanchion member being attached to said outer and inner vertical frames, respectively, of said sliding panel portion by fastener means, and said second end stanchion member being attached to said outer vertical frame member of said fixed panel portion by fastener means.

2. The sliding door of claim 1 wherein said middle stanchion member is adapted to be moved along the length of said outside tube member to bring it into alignment with said frame of said sliding panel portion.

3. The sliding door of claim 1 including a washer-shaped dust cover attached to the second end of said outside tube member, said dust cover adapted to minimize entry of dust into the space between said outside tube member and said inside tube member, and to provide support for said inside tube member.

4. The sliding door of claim 1 including an end piece attached to said inside tube member adjacent its first end, said end piece being in sliding engagement with the inner wall of said outside tube.

5. The sliding door of claim 1 wherein said first end stanchion and said middle stanchion each includes a collar portion surrounding and attached to said outside tube member adjacent said first and second ends thereof, respectively, and said second end stanchion includes a collar portion surrounding and attached to said inside tube member adjacent the second end thereof, each of said stanchions having an L-shaped attachment bracket extending from said collar portion, said L-shaped attachment bracket having a first leg substantially perpendicular to the longitudinal axis of said outside and inside tube members, and a second leg that is substantially parallel to the longitudinal axis of said outside and inside tube members, and fastener members attaching said stanchions to said vertical frame members of said panels.

* * * * *